US005216992A

United States Patent [19]

Ropertz et al.

[11] Patent Number: 5,216,992

[45] Date of Patent: Jun. 8, 1993

[54] THROTTLE DEVICE ACTUATOR

[76] Inventors: Peter Ropertz, Kelterstr. 33, 7145 Markgroeningen 2; Karl Gmelin, Eichendorffweg 5, 7101 Flein, both of Fed. Rep. of Germany

[21] Appl. No.: 935,716

[22] Filed: Aug. 27, 1992

[30] Foreign Application Priority Data

Oct. 12, 1991 [DE] Fed. Rep. of Germany ..... 4133858

[51] Int. Cl.[5] ..... F02D 9/02

[52] U.S. Cl. ..... 123/400; 251/305

[58] Field of Search ..... 123/400, 403; 251/305; 74/502.5, 502.6

[56] References Cited

U.S. PATENT DOCUMENTS 4,889,093 12/1989 Nishiyama et al. ..... 123/400
4,907,553 3/1990 Porter ..... 123/400
4,945,874 8/1990 Nishitani et al. ..... 123/400
5,048,485 9/1991 Terazawa et al. ..... 123/400 X
5,168,852 12/1992 Moriguchi et al. ..... 123/400

*Primary Examiner*—Willis R. Wolfe

[57] ABSTRACT

A novel throttle device adjuster having a U-shaped fastening bracket, connected to a throttle valve shaft and having a sawtooth contour in the region of two locking segments that pass through a pulley in two fastening bracket receptacles; the sawtooth contour, together with the fastening bracket receptacles, produces a firm connection of the pulley to the fastening bracket without further connecting elements. The novel throttle device adjuster is especially suitable for throttle equipment in internal combustion engines of either the mixture-compressing, externally ignited or the air-compressing, self-ignited type. Instead of the sawtooth contour the two locking segments may pass through slots in the pulley and be bent over.

3 Claims, 2 Drawing Sheets

THROTTLE DEVICE ACTUATOR

BACKGROUND OF THE INVENTION

The invention is based on a throttle device actuator as defined hereinafter. A throttle device actuator is already known for controlling a throttling device, such as a throttle valve, in an air intake tube of a mixture-compressing internal combustion engine with externally supplied ignition; it has a U-shaped fastening bracket that is mounted between two shims on an end tang of the throttle valve shaft that is separated from the main part of a throttle valve shaft by a shoulder. The end tang has two opposed flat faces. The end tang receptacle of the fastening bracket is provided with two opposed flat faces matching the shape of the end tang, so that a form-fitting connection of the fastening bracket to the throttle valve shaft enables torque transmission. The fastening bracket is secured on the throttle valve shaft by a fastening nut, which cooperates with a thread cut into curved surfaces located between the flat faces of the end tang.

Both legs of the U-shaped fastening bracket pass through two recesses, which are disposed suitably spaced apart in a pulley of the throttle device actuator and have the shape of the cross section of the legs, so that the pulley is connected to the throttle valve shaft without play via the fastening bracket. The pulley is fixed to the fastening bracket by a retaining clamp that is supported on a recess on each of the two legs and forces the pulley against two shoulders of the legs of the fastening bracket. A Bowden cable, which is actuatable by a so-called gas pedal engages the pulley in a known manner.

The retaining clamp covers the fastening nut and thus blocks off access to the fastening nut, so that the various components must be installed successively, in this order: shim, fastening bracket, shim, fastening nut, pulley and retaining clamp. Installing individual components, preassembled and combined into structural units, which would lessen the effort of installation and thus lower the production costs, is not possible in this device.

OBJECT AND SUMMARY OF THE INVENTION

The throttle device actuator according to the invention has an advantage over the prior art that from the pulley and fastening bracket, without additional connecting elements, a single component is formed that can be mounted on the throttle valve shaft. Eliminating the retaining clamp that a throttle device actuator of the prior art requires makes the fastening nut freely accessible, so that the effort of installation and production costs can be lowered in a simple manner by using preassembled component units.

Fixing the pulley to the fastening bracket by means of bent-over tabs makes it possible for the pulley and fastening bracket, preassembled to a component unit, to be separated from one another once again without the two parts' being destroyed.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
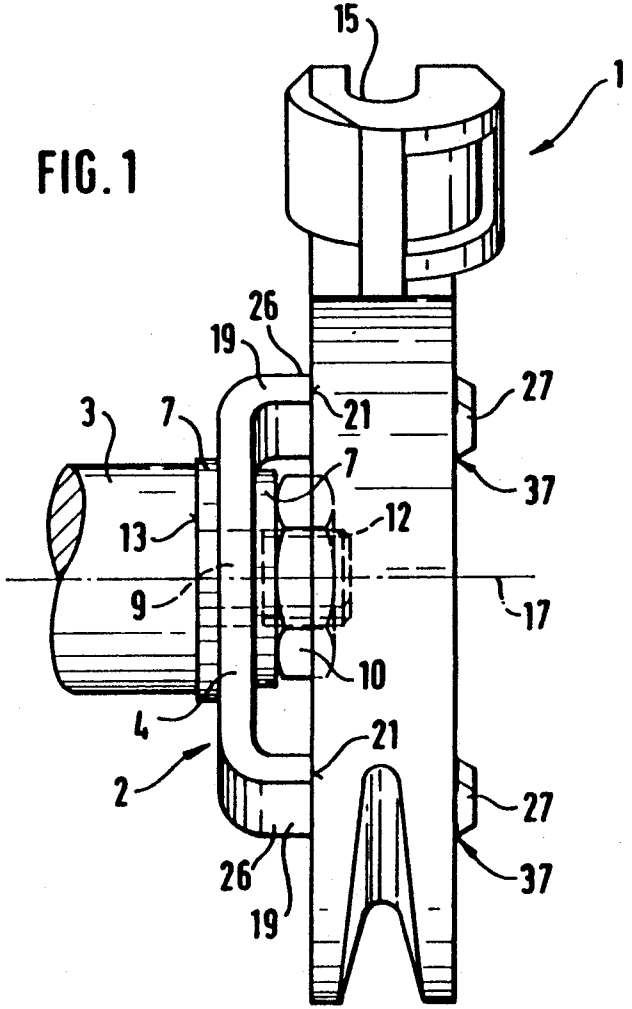
FIG. 1 shows a throttle valve adjuster embodied according to the invention in terms of a first exemplary embodiment.
Figure 2:
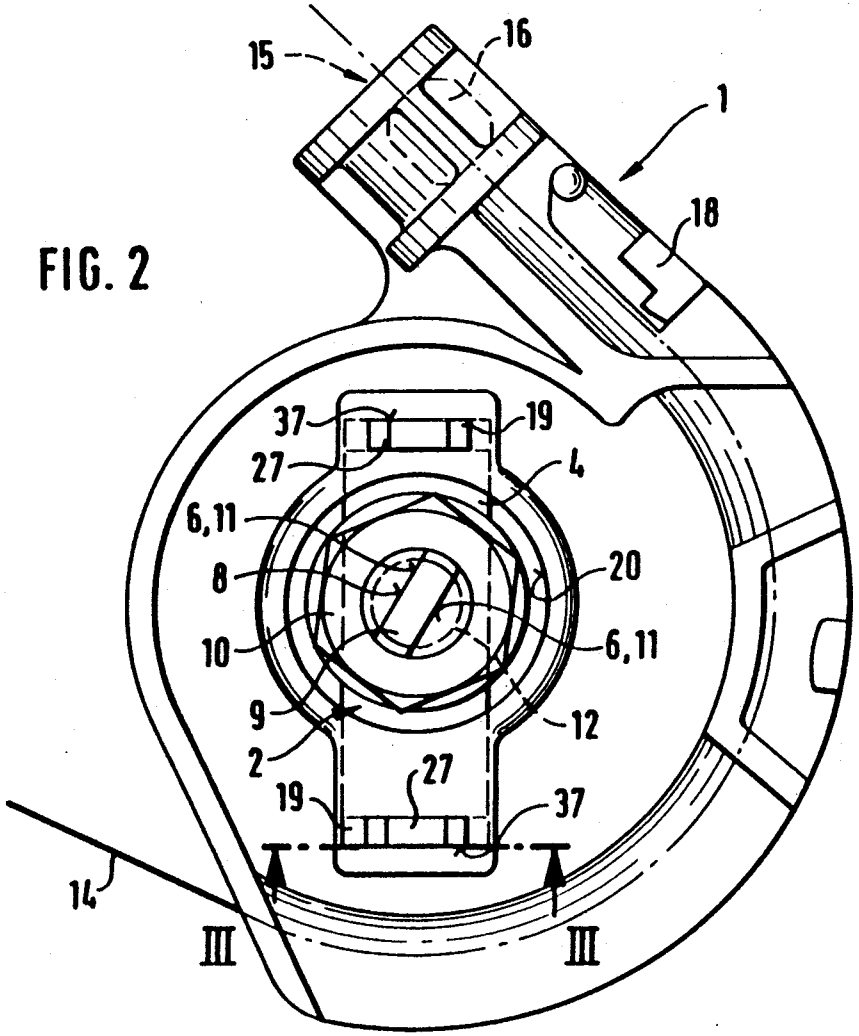
FIG. 2 is a side view of the throttle valve adjuster of FIG. 1.
Figure 3:
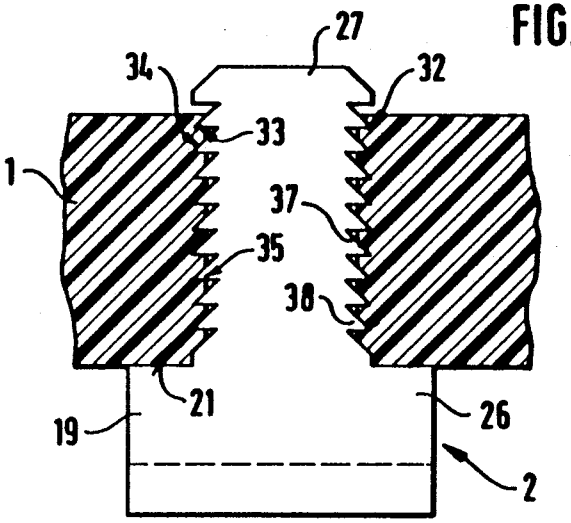
FIG. 3 is a section through one leg of a fastening bracket taken along the line III—III of FIG. 2.

In FIGS. 1, 2 and 3, the drawing shows a first exemplary embodiment of a throttle device adjuster, having a pulley 1, which is made of plastic, for instance, and a U-shaped fastening bracket 2, bent from steel, for instance. The pulley 1 is joined by means of the fastening bracket 2 to a throttle valve shaft 3 for controlling a throttle device, not shown, such as a throttle valve in an air intake tube of an internal combustion engine. An intermediate segment 4 of the fastening bracket is mounted between two shims 7 on an end tang 9 of the throttle valve shaft 3. The end tang 9 has two opposed flat faces 6. An end tang receptacle 8 in the form of an oblong slot penetrates the intermediate portion 4 and likewise has two flat faces 11 corresponding to the shape of the end tang 9, so that a form-fitting connection comes about between the throttle valve shaft 3 and the fastening bracket 2, enabling torque transmission. With the interposition of the shim 7, the fastening bracket 2 is braced against a shoulder 13 of the throttle valve shaft 3 by a fastening nut 10 that is screwed onto a thread 12 of the end tang 9, and is secured on the throttle valve shaft 3.

A fastening head 16 of a Bowden cable 14 is suspended in a recess 15 of the pulley 1. A holding-down device 18 that fits over the Bowden cable 14 along the throttle valve shaft 3 prevents the fastening head 16 of the Bowden cable 14 from sliding unintentionally out of the recess 15 of the pulley 1. Via the cable 14, the pulley 1 is joined to some device, not shown, for controlling the position of the throttle device, such as a gas pedal of a vehicle. The fastening bracket 2, the pulley 1 and the throttle valve shaft 3 rotate about a throttle valve axis 17 upon actuation of the control device. As shown in FIG. 2 of the drawing, a recess 2 coaxial with the throttle valve axis 17 is formed in the pulley 1; it is dimensioned such that the two shims 7 and the fastening nut 10 can be mounted o the thread 12 or on the end tang 9 through the recess 20, and the fastening nut 10 can be tightened or loosened with a suitable tool for that purpose.

The fastening bracket 2 has one stepped leg 19 each on both ends of the intermediate segment 4 and bent at right angles to it. The two opposed legs 19 are parallel to one another, and each has a shoulder 21, which separates a spacer segment 26 of thicker cross section from a locking segment 27 of more slender cross section. The shoulder 21 serves as a stop for the pulley 1. The locking segment 27 rests on the end remote from the intermediate segment 4 of each leg 19 and has a sawtooth contour 32 on its surface, as shown in FIG. 3 of the drawing. The length of the locking segment 27 is equal to at least the thickness of the pulley 1 in the region of two fastening bracket receptacles 37. In the region of the sawtooth contour 32, each sawtooth 38 is formed by a radially extending annular face 33 and a conical face 34 intersecting it. The conical faces 34 are inclined by an angle of 45°, for example, from the annular faces 33 in the direction of the shoulder 21, which facilitates slipping the pulley 1 onto the locking segments 27 of the fastening bracket 2.

The pulley 1 has two fastening bracket receptacles 37, corresponding to the spacing and cross section of the locking segments 27; their cross section is located between the core cross section and the outer cross section of the sawtooth contour 32 of the locking segment 27. Upon installation, the pulley 1 is slipped with the fastening bracket receptacles 37 onto the fastening bracket 2 far enough that the pulley 1 rests on the shoulders 21 of the legs 19, the shoulders being formed by the locking segments 27 and the spacer segments 26. The locking segments 27 of the fastening bracket 2 penetrate the fastening bracket receptacles 37 of the pulley 1. The barblike points 35 of the sawtooth contour 32, which are formed by the cone faces 34 in the annular faces 33 penetrate at least part way into the surface of the fastening bracket receptacles 37 of the pulley 1, because of the different hardness of the metal used for the fastening bracket 2 and of the softer plastic used for the pulley 1, resulting in a firm connection of the pulley 1 to the fastening bracket 2. Slipping the pulley 1 onto the fastening bracket 2 is made easier by the inclined position of the cone faces 34. Once assembly is complete the sawtooth contour 32 of the legs 19 effectively prevents the fastening bracket 2 from sliding out of the fastening bracket receptacles 37 of the pulley 1. The fastening bracket 2 has a rectangular cross section, for example, so that the rectangular legs 19 protrude into likewise rectangularly embodied fastening bracket receptacles 37 of the pulley and dig into them with the sawtooth contour 32 formed on the narrow sides of the locking segments 27.

Figure 5:
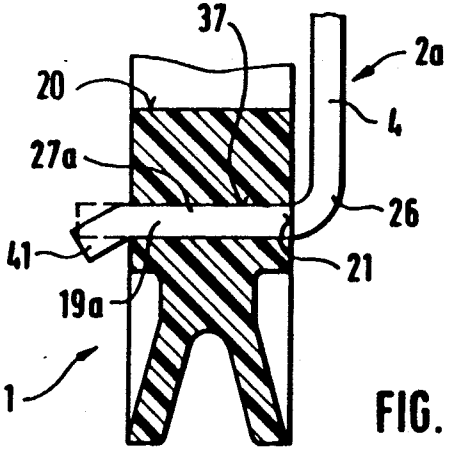
FIG. 5 is a section through one leg of a fastening bracket taken along the line V—V of FIG. 4.
Figure 4:
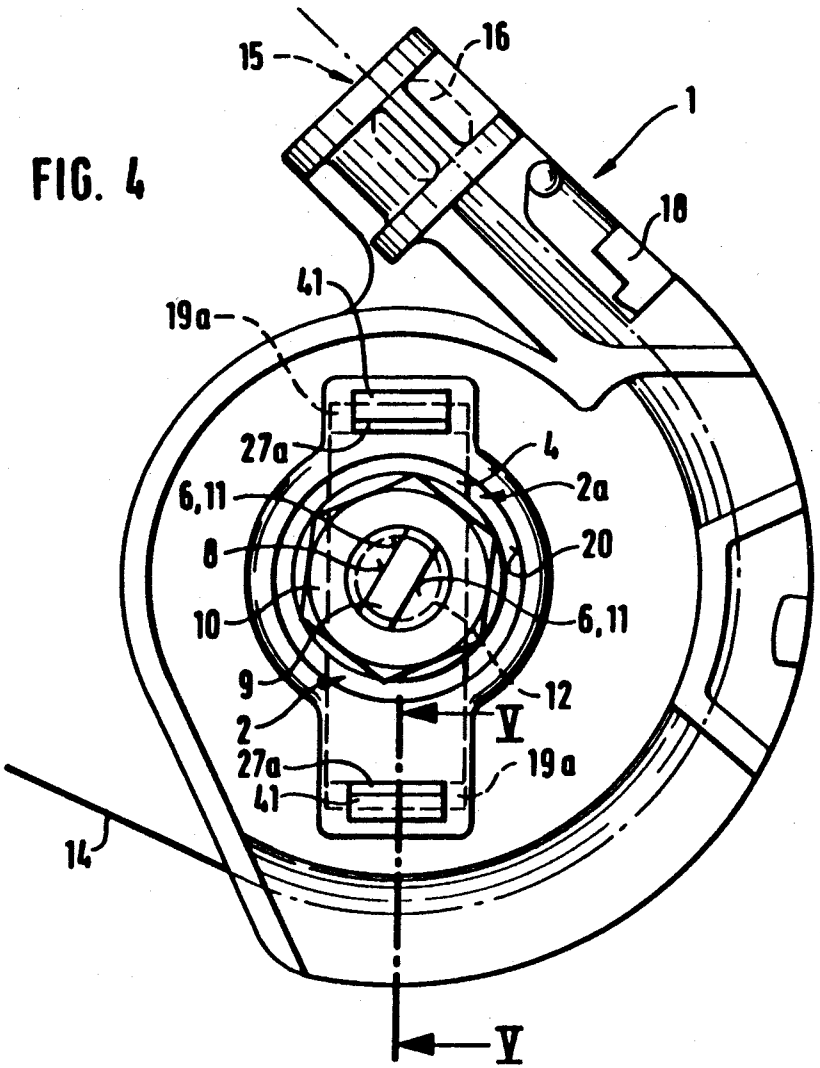
FIG. 4 is a side view of the throttle valve adjuster in a second exemplary embodiment.

In a second exemplary embodiment of a throttle valve actuator of FIGS. 4 and 5 of the drawing, the components that function the same and remain the same as those of the first exemplary embodiment of FIGS. 1, 2 and 3 are identified by the same reference numerals. As in the first exemplary embodiment, an intermediate segment 4 of the U-shaped fastening bracket **2*a* is provided with the end tang receptacle 8 and mounted between two shims 7 on the end tang 9 of the throttle valve shaft 3. The end tang 9 has two opposed flat faces 6. The end tang receptacle 8 of the intermediate segment 4 has two flat faces 11 as well, corresponding to the form of the end tang 9, so that a form-fitting connection comes about between the throttle valve shaft 3 and the fastening bracket 2*a*, which enables torque transmission. The fastening bracket 2*a* is braced against the shoulder 13 of the throttle valve shaft 3 and secured on the throttle valve shaft 3 by the fastening nut 10, which is screwed onto the thread 12 of the end tang 9, with the interposition of the shim 7**.

The fastening bracket **2*a* has one stepped leg 19*a* each on both ends of the intermediate segment 4 and bent at right angles to it. The two opposed legs 19*a* are parallel to one another, and each has a shoulder 21, which separates a spacer segment 26 of thicker cross section from a locking segment 27*a* of more slender cross section and serves as a stop for the pulley 1. The locking segment 27*a* rests on the end remote from the intermediate segment 4 of each leg 19*a***.

The pulley 1 has two fastening bracket receptacles 37, corresponding to the spacing of the locking segments **27*a*; their cross section corresponds to the cross section of the locking segments 27*a*, so that the pulley 1 is seated without circumferential play on the fastening bracket 2*a*. Upon installation, the pulley 1 is slipped onto the two legs 19*a* of the fastening bracket 2*a* far enough that the pulley 1 rests on the shoulders 21 of the fastening bracket 2*a* that are formed by the locking segments 27*a* and the spacer segments 26. The locking segments 27*a* of the fastening bracket 2*a* penetrate the fastening bracket receptacles 37 of the pulley 1 at least far enough that part of each locking segment 27*a* protrudes, in the form of a bent-over tab 41, past the pulley 1**.

For fixing the pulley 1 on the fastening bracket **2*a*, the bent-over tab 41 of each leg 19*a* of the fastening bracket 2*a*, protruding past the pulley 1 on the side remote from the throttle valve shaft 3, is bent over counter to the course of each leg 19*a* in the fastening receptacles 37, so that a form-fitting connection is established between the pulley and the fastening bracket 2*a*, and the pulley 1 is firmly joined to the fastening bracket 2*a*. In FIG. 5, the bent-over tab 41 is shown in dashed lines in a position not bent at an angle for installation and in solid lines in a bent position that accordingly fixes the pulley 1. The fastening bracket 2*a* has a rectangular cross section, for example, so that the rectangular legs 19*a* protrude into likewise rectangularly embodied fastening bracket receptacles of the pulley 1**.

By means of the embodiments of the throttle device adjuster that are described above and are in accordance with the invention, the pulley 1 and the fastening bracket 2 can be combined into a component unit that is then mounted on the throttle valve shaft 3 and secured with the fastening nut 10. The novel throttle device adjuster is especially suitable for throttle equipment in mixture-compressing, externally ignited or air-compressing, self-ignited internal combustion engines.

The foregoing relates to preferred exemplary embodiments of the invention, it being understood that other variants and embodiments thereof are possible within the spirit and scope of the invention, the latter being defined by the appended claims.

WHAT IS CLAIMED AND DESIRED TO BE SECURED BY LETTERS PATENT OF THE UNITED STATES IS:

1. A throttle device actuator of an internal combustion engine, having a U-shaped fastening bracket and a pulley mounted on the fastening bracket, the pulley is connected via a Bowden cable to a device controlling the rotational angle of a throttle valve shaft to which the U-shaped fastening bracket is secured, wherein the fastening bracket has an intermediate segment and two legs that include a locking segment that protrudes into fastening bracket receptacles of the pulley.

2. A throttle device actuator as set forth in claim 1 in which each locking segment (27) has a sawtooth contour (32), which digs into a wall of the fastening bracket receptacles (37) of the pulley (1) in order to secure the pulley to said fastening bracket.

3. A throttle device actuator as set forth in claim 1, in which each locking segment (**27*a*) has one bent-over tab (41) that protrudes beyond the pulley (1), which is bent over onto the pulley (1) and fixes the pulley (1) on the fastening bracket (2*a***).

* * * * *

UNITED STATES PATENT AND TRADEMARK OFFICE

CERTIFICATE OF CORRECTION

PATENT NO. : 5,216,992
DATED : June 8, 1993
INVENTOR(S) : Peter Ropertz, et. al.

It is certified that error appears in the above-indentified patent and that said Letters Patent is hereby corrected as shown below:

Title page, item [73], Assignee, should read--Robert Bosch GmbH, Stuttgart, Fed. Rep. of Germany--.

Title page, item [56], under References Cited, col. 2, line 4, insert--Attorney, Agent or Firm: Edwin E. Greigg, Ronald E. Greigg--.

Signed and Sealed this

Twentieth Day of September, 1994

*Attest:*

*Attesting Officer*

Bruce Lehman

BRUCE LEHMAN

*Commissioner of Patents and Trademarks*